US005598255A

United States Patent [19]

De Cock et al.

[11] Patent Number: 5,598,255

[45] Date of Patent: Jan. 28, 1997

[54] ELECTROSTATOGRAPHIC PRINTER FOR FORMING A TONER IMAGE ONTO A RECEPTOR WEB ADAPTED TO REDUCE SMUDGING

[75] Inventors: Etienne M. De Cock; Lucien A. De Schamphelaere, both of Edegem; Bart J. Van Dessel, St-Antonius, all of Belgium

[73] Assignee: Xeikon N.V., Mortsel, Belgium

[21] Appl. No.: 398,899

[22] Filed: Mar. 6, 1995

[30] Foreign Application Priority Data

Mar. 11, 1994 [EP] European Pat. Off. ..... 94301783

[51] Int. Cl.[6] ..... G03G 15/14

[52] U.S. Cl. ..... 355/234; 355/297

[58] Field of Search ..... 355/271, 274, 355/245, 326 R, 327, 296, 297

[56] References Cited

U.S. PATENT DOCUMENTS

| | | | |
|---|---|---|---|
| 4,339,196 | 7/1982 | Beck | 355/3 |
| 4,583,832 | 4/1986 | Kasamura et al. | 355/3 |
| 4,801,966 | 1/1989 | Ikeda | 355/4 |
| 4,814,816 | 3/1989 | Idenawa | 355/3 |
| 5,066,988 | 11/1991 | Miyake | 355/245 |
| 5,147,745 | 9/1992 | Russel | 430/49 |
| 5,160,946 | 11/1992 | Hwang | 346/157 |

FOREIGN PATENT DOCUMENTS

| | | |
|---|---|---|
| 0287122 | 10/1988 | European Pat. Off. . |
| 63-249164 | 10/1988 | Japan . |

*Primary Examiner*—Arthur T. Grimley
*Assistant Examiner*—Quana Grainger
*Attorney, Agent, or Firm*—Brumbaugh, Graves, Donohue & Raymond

[57] ABSTRACT

An electrostatographic printer for forming a toner image onto a receptor element comprises: (i) at least one toner image-producing electrostatographic station comprising rotatable endless surface means onto which a toner image can be formed, means for forming an electrostatic latent image on the endless surface means and a developing unit for depositing electrostatically charged toner particles onto the electrostatic latent image; (ii) means for conveying a receptor element past the image-producing station; and (iii) transfer means for transferring the toner image on the rotatable surface means onto the receptor element web. The printer is characterized in that the developing unit is selectively moveable between an operative position and a non-operative position while the endless surface means rotates. The printer avoids smudging on the first few prints produced by the printer.

14 Claims, 4 Drawing Sheets

Figure 1:
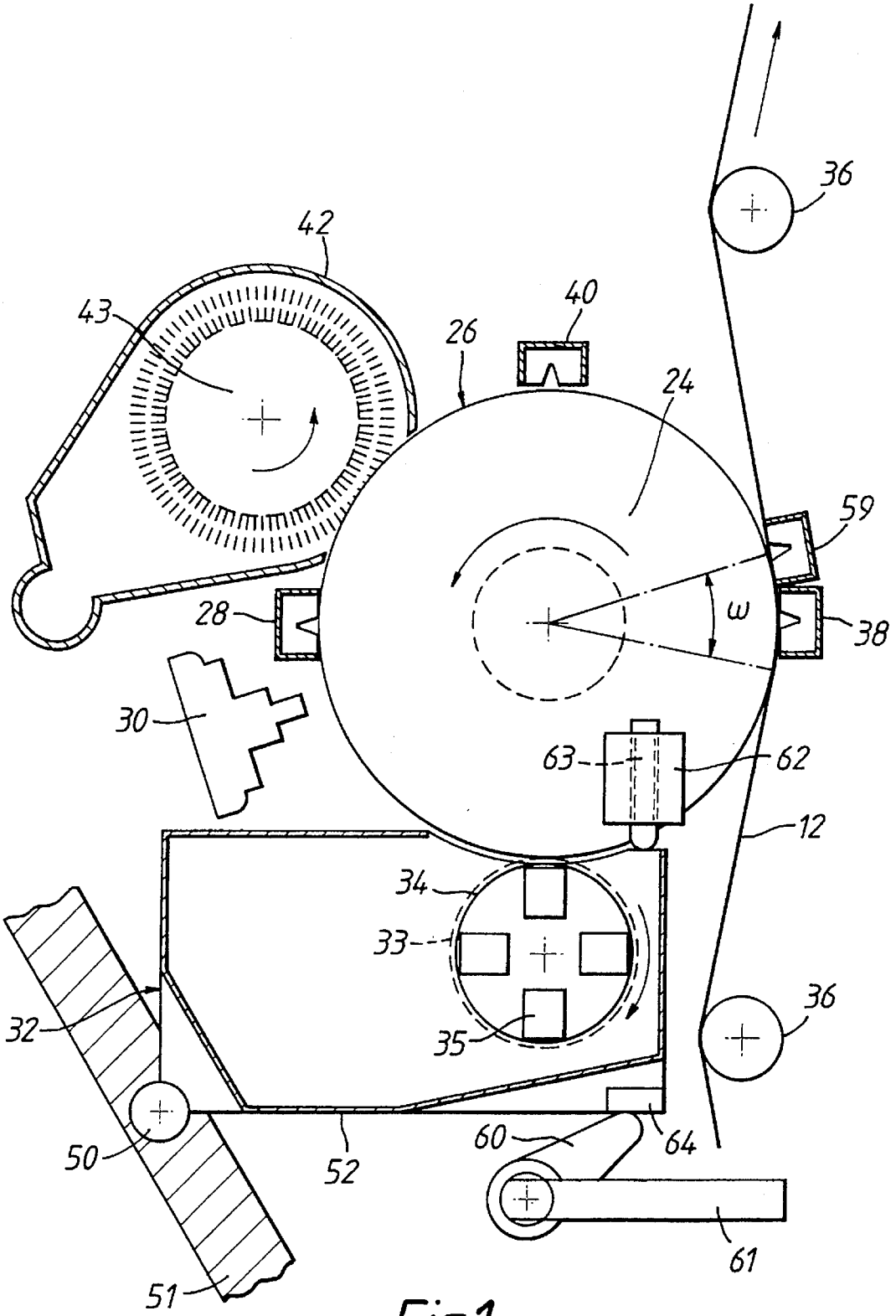

ELECTROSTATOGRAPHIC PRINTER FOR FORMING A TONER IMAGE ONTO A RECEPTOR WEB ADAPTED TO REDUCE SMUDGING

FIELD OF THE INVENTION

This invention relates to an electrostatographic printer for forming an image onto a receptor element and to a method of operating such a printer. In particular, this invention relates to an electrostatographic printer, especially such a printer as is capable of printing color images for professional purposes as a cost effective alternative to conventional printing of short to medium sized runs.

BACKGROUND OF THE INVENTION

Electrostatographic printing operates according to the principles and embodiments of non-impact printing as described, e.g., in "Principles of Non-Impact Printing" by Jerome L Johnson (1986) - Palatino Press - Irvine Calif., 92715 USA).

Electrostatographic printing includes electrographic printing in which an electrostatic charge is deposited image-wise, e.g. by ionography, on a dielectric recording member as well as electrophotographic printing in which an overall electrostatically charged photoconductive dielectric recording member is image-wise exposed to conductivity increasing radiation producing thereby a "direct" or "reversal" toner-developable charge pattern on the recording member. "Direct" development is a positive-positive development, and is particularly useful for reproducing pictures and text. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, i.e. computer stored information.

In the electrophotographic art, an electrostatographic single-pass multiple station multi-color printer is known, in which an image is formed on a photoconductive belt and is then transferred to a paper receiving sheet or web whereon the toner image is fixed, whereupon the web is usually cut into sheets containing the desired print frame.

In an alternative printer, toner images are transferred to an insulating belt from distinct image forming stations and are then transferred to the receiving sheet or web and fixed thereon.

In U.S. Pat. No. 3,694,073 (Bhagat/Xerox Corporation), there is described an electrostatographic printer for forming an image onto a web. The printer comprises a plurality of toner image-producing stations each comprising a photoconductive drum as an electrostatic image element, onto which a toner image can be formed, means for forming an electrostatic latent image on each drum and a developing unit for depositing toner onto the electrostatic latent image to render the image visible and transferable. The printer further includes means for conveying a web past the image-producing stations and transfer means for transferring the toner image on the drum onto the web.

In a printer in which the developing unit brings toner particles into contact with the electrostatic imaging element, for example in the form of a drum or an endless belt, there will still be contact with the toner in the non-printing stage and toner adhering to the imaging element web becomes transferred to the receptor element as the printing process is started, resulting in smudging on the first few prints. This problem occurs for example when the printer is not printing for a certain period of time.

We have discovered that a solution to this problem is provided if the developing unit is selectively moveable between an operative position and a non-operative position while the drum rotates, thereby enabling the developing unit to be located in a position out of contact with the drum when the printer is not in use.

SUMMARY OF THE INVENTION

Thus, according to a first aspect of the present invention there is provided an electrostatographic printer for forming an image onto a receptor element, which printer comprises:

(i) at least one toner image-producing electrostatographic station comprising rotatable endless surface means onto which a toner image can be formed, means for forming an electrostatic latent image on the endless surface means and a developing unit for depositing electrostatically charged toner particles onto the electrostatic latent image;

(ii) means for conveying a receptor element in the form of a web past the image-producing station; and (iii) transfer means for transferring the toner image on the rotatable surface means onto the receptor element web, characterized in that the developing unit is selectively moveable between an operative position and a non-operative position while the endless surface means rotates.

According to a second aspect of the invention, there is provided a method of operating an electrostatographic printer comprising the steps of:

forming an electrostatic latent image on rotatable endless surface means at at least one image-producing electrostatographic station;

depositing electrostatically charged toner particles from a developing unit onto the electrostatic latent image on to form a toner image on the rotatable endless surface means;

conveying a receptor element in the form of a web past the image-producing station; and transferring the toner image on the rotatable surface means onto the receptor element web to form an image thereon, characterized by selectively moving the developing unit between an operative position and a non-operative position while the endless surface means rotates.

By "operative position" is meant in the present invention that the developing unit is present in a position in which toner particles from the developing unit can deposit onto the surface of the endless surface means by physical contact and/or by attraction by electrostatic charges present thereon. In a "non-operative" position the distance between the toner source of the developing unit and the surface is increased so that toner-deposition onto the surface can no longer take place.

Preferably the printer is in the form of a multi-station printer comprising a plurality of said image-producing stations, the printer including means for conveying the receptor element web in succession past each of the image-producing stations. However, the invention is equally applicable to printers comprising only a single image-producing station.

Usually, the rotatable endless surface means comprises a belt or the circumferential surface of a drum, especially a belt or drum which has a photoconductive surface. In the following general description, reference is made to a drum, but it is to be understood that such references are also applicable to endless belts or to any other form of endless surface means.

Each toner image-producing electrostatographic station preferably comprises means for charging the surface of the drum, and usually the surface of the drums at all the image-producing stations are charged to the same polarity. Using photoconductors of the organic type, it is most convenient to charge the surface of the drums to a negative polarity and to develop the latent image formed thereon in reversal development mode by the use of a negatively charged toner.

The means for image-wise exposing the charged surface of the drum or belt may comprise an array of image-wise modulated light-emitting diodes or take the form of a scanning laser beam.

The toner will usually be in dry particulate form, but the invention is equally applicable where the toner particles are present as a dispersion in a liquid carrier medium forming a so-called electrophoretic developer.

In one convenient embodiment, each developing unit comprises a driven rotatable magnetic developing brush in contact with the drum in the operative position of the developing unit. The position and/or the speed of this brush relative to the drum surface may be adjustable thereby to optimize the development results. Thus it is preferred that the developing brush is adjustably mounted within the developing unit, enabling it to be moved radially towards or away from the drum.

The developing unit conveniently comprises a housing, pivotally mounted on a frame member of the printer on which the drum is carried. Preferably, the developing unit comprises means for mixing toner particles and carrier particles in the housing of the unit in both the operative and the non-operative positions.

Although a developing unit operating with a magnetic brush is a favored device in many commercial electrostatographic copiers and printers, alternatives thereto have been proposed such as "touchdown" or "impression" development systems some of them being discussed in U.S. Pat. No. 4,271,249 and U.S. Pat. No. 5,012,288. In a typical touchdown development system (see United States patent U.S. Pat. No. 3,739,748) a cylindrical or endless applicator called a donor member is rotated so that its surface can be presented to the moving surface of a photoconductive drum bearing an electrostatic latent image thereon. Positioned about the periphery of the donor member are a number of processing stations including a toner loading station, at which toner is deposited on the donor member surface; an agglomerate removal station of which toner agglomerates are removed from the toner layer retained on the surface of the donor member; a charging station at which a uniform charge is placed on the toner particles retained on the donor surface; a clean up or levelling station at which the toner layer is converted into one uniform thickness and at which toner agglomerates not removed by the agglomerate removing station are removed; a development station at which the toner particles carried by the donor member are presented to the imaged photoconductor for image development; a cleaning station at which neutralizing charge is placed upon the residual toner particles on the donor member and a cleaning member which removes residual toner from the peripheral surface of the donor member, wherefrom the removed toner may be recycled for use in a further printing cycle.

Another useful development system which can be used in an electrostatographic printer according to the present invention, comprises a developing unit known as a "jump-over development system" or as a "toner projection system"—see e.g. Electrophotography Fourth International Conference, Nov. 16–18, 1981 Washington D.C., edited by S. W. Ing, M.D. Tabak and W.E. Haas Society of Photographic Scientists and Engineers (SPSE) 7003 Kilworth Lane, Springfield, Va., USA, and U.S. Pat. No. 4,370,049.

A survey of developing methods for use in electrophotography including the above defined methods and others is given in the periodical Bild und Ton 39 (1986) 4, p. 112–116.

In one embodiment of the invention, the receptor element web may constitute a final support for the toner images and is unwound from a roll, fixing means being provided for fixing the transferred images on the web. In this embodiment, the printer may further comprise a roll stand for unwinding a roll of web to be printed in the printer, and a web cutter for cutting the printed web into sheets. The drive means for the web may comprise one or more drive rollers, preferably at least one drive roller being positioned downstream of the image-producing stations and a brake or at least one drive roller being positioned upstream of the image-producing stations.

Preferably the web is conveyed through the printer at a speed of from 5 cm/sec to 50 cm/sec and the tension in the web at each image-producing station preferably lies within the range of 0.2 to 2.0N/cm web width.

In an alternative embodiment of the invention, the receptor element web is a temporary support in the form of a tensioned endless belt, and the printer further comprises transfer means for transferring the images formed on the belt onto a final support, fixing means being provided for fixing the transferred images on the final support. In this embodiment, the final support may also be in the form of a web or it may be in sheet form.

Adherent contact of the toner receiving web with the drum may be such that the movement of the web controls the peripheral speed of the drum in synchronism with the movement of the web. This adherent contact may be obtained at least partly by guiding means, for example freely rotating rollers, positioned to define a wrapping angle with respect to the drum, preferably a wrapping angle of from 5° to 30°, preferably from 10° to 20° . The guiding means contacts the web on the side thereof opposite to that on which the toner images are transferred. The guiding means are preferably guiding rollers but may, for example, alternatively be formed by stationary air-bearings.

The transfer means is in the form of a corona discharge device which sprays charged particles having a charge opposite to that of the toner particles. The supply current fed to the corona discharge device is preferably within the range of 1 to 10 μA/cm web width, most preferably from 2 to 5 μA/cm web width, depending upon the paper characteristics and will be positioned at a distance of from 3 mm to 10 mm from the path of the web.

Where the printer is a multi-station printer, the developing units at the plurality of image-producing stations may be linked together for simultaneous movement between the operative and non-operative positions.

The printer may further comprise reciprocating drive means for moving the or each developing unit between the operating and non-operating positions.

The drive means for moving the or each developing unit between the operating and non-operating position may be a linear actuator such as a linear electric motor but may be any kind of actuator means for linear reciprocal movement, e.g. a pneumatic device.

As an alternative, each of the printing stations is provided with its own reciprocating motion mechanism for individually positioning each developing unit.

Preferably, the printer according to the invention further comprises control means for controlling the timed relationship between movement of the or each developing unit and operation of the printer. This control means is preferably such as to enable the or each developing unit to be moved out of the operative position before the drum stops rotating. Thus, at the end of a printing run, the developing unit can be moved away from the drum while the latter is still rotating, the rotation of the drum and the synchronous movement of the web being stopped after the drum has rotated sufficiently that any latent image carried thereon has been erased. The developing unit then preferably remains at a distance from the drum sufficient to avoid toner deposition on the drum, while the printer is not printing. Additionally, or alternatively, the control means enable the drum to start rotating before the or each developing unit is moved into the operative position. Thus, it is not possible for toner to be transferred to the drum and thence to the web until the drum has rotated sufficiently to have any residual image erased therefrom and a new latent image formed thereon.

Preferably, the printer according to the invention comprises means to bring the or each developing unit into a service position in which the developing unit can be removed from the printer.

The printer construction according to the invention is particularly advantageous where the printer is a multi-color printer comprising magenta, cyan, yellow and black printing stations. Thus the printer may be a multi-color printer comprising a plurality of developing units wherein the printer contains means to put at least one of the developing units into an operative position while one or more other developing units remain in a non-operative position.

Printers as described and claimed in the unpublished European patent applications EP-A-629924 and EP-A-631204 filed on 18 Jun. 1993 (Xeikon Nev.) which are suitable for multi-color printing e.g. with magenta, cyan, yellow and black toner can be modified to become printers within the scope of the present invention by including therein means for bringing their several developing units selectively in operative and non-operative position as described herein.

PREFERRED EMBODIMENTS OF THE INVENTION

Figure 2A:
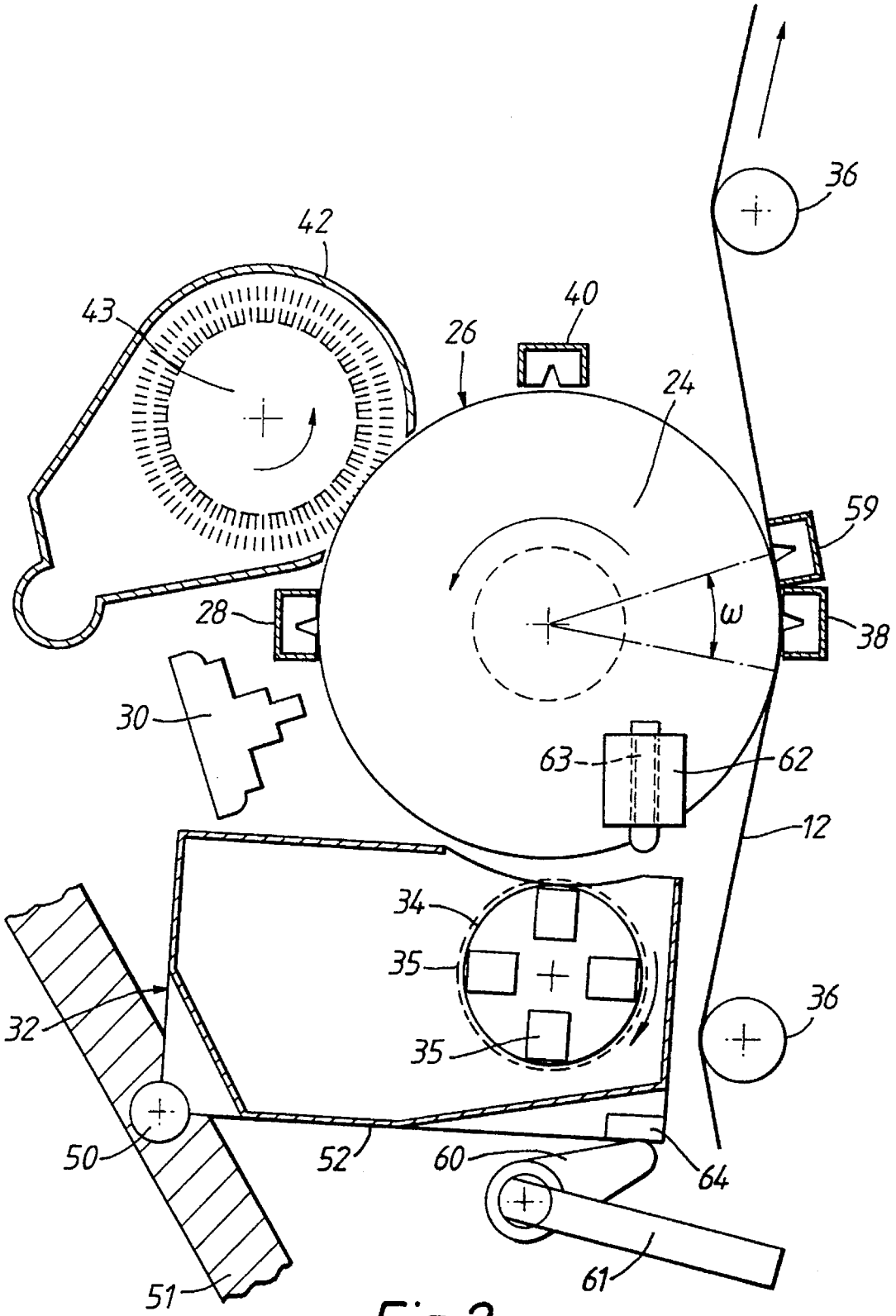
Figure 2B:
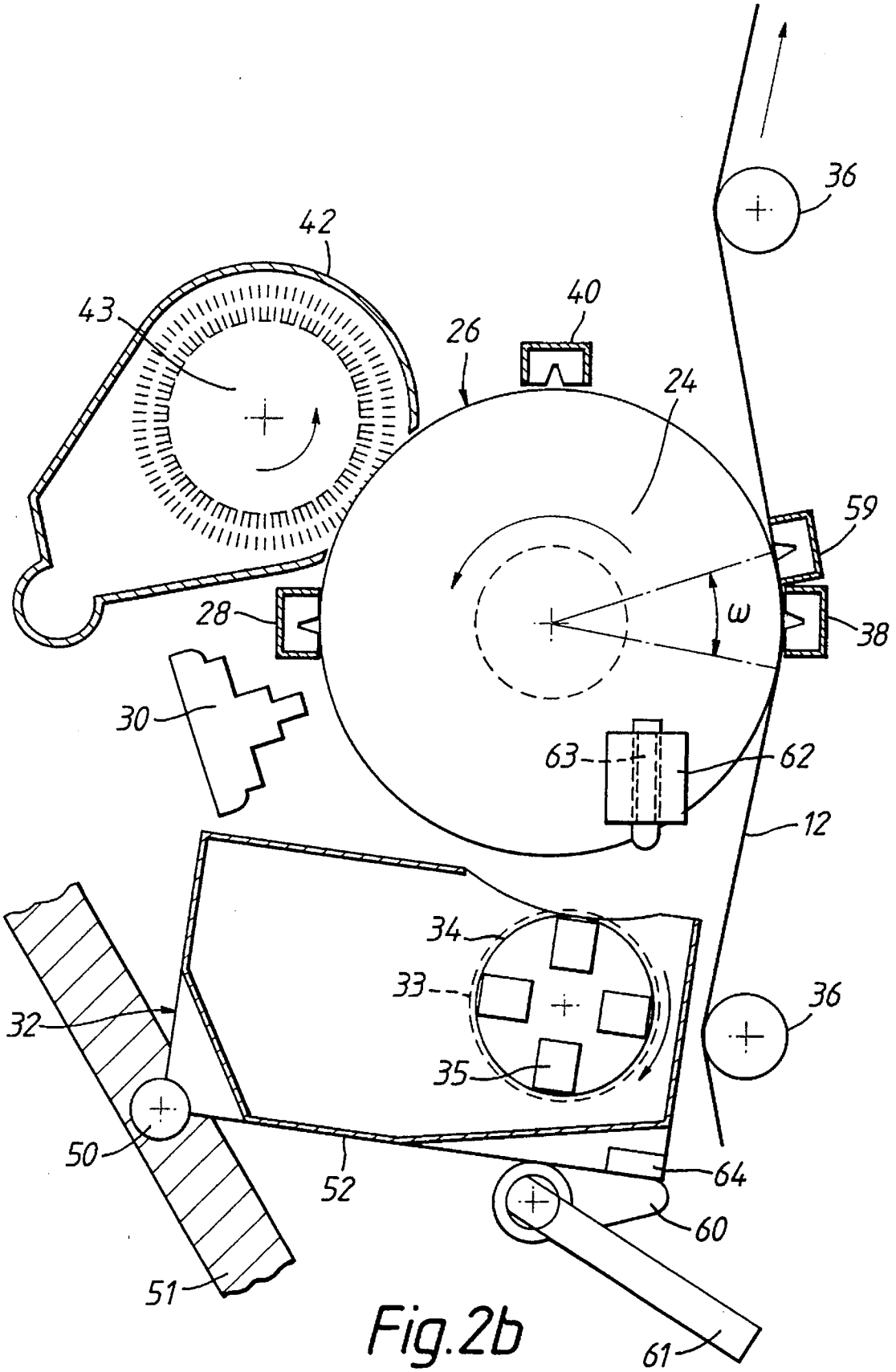
Figure 3:
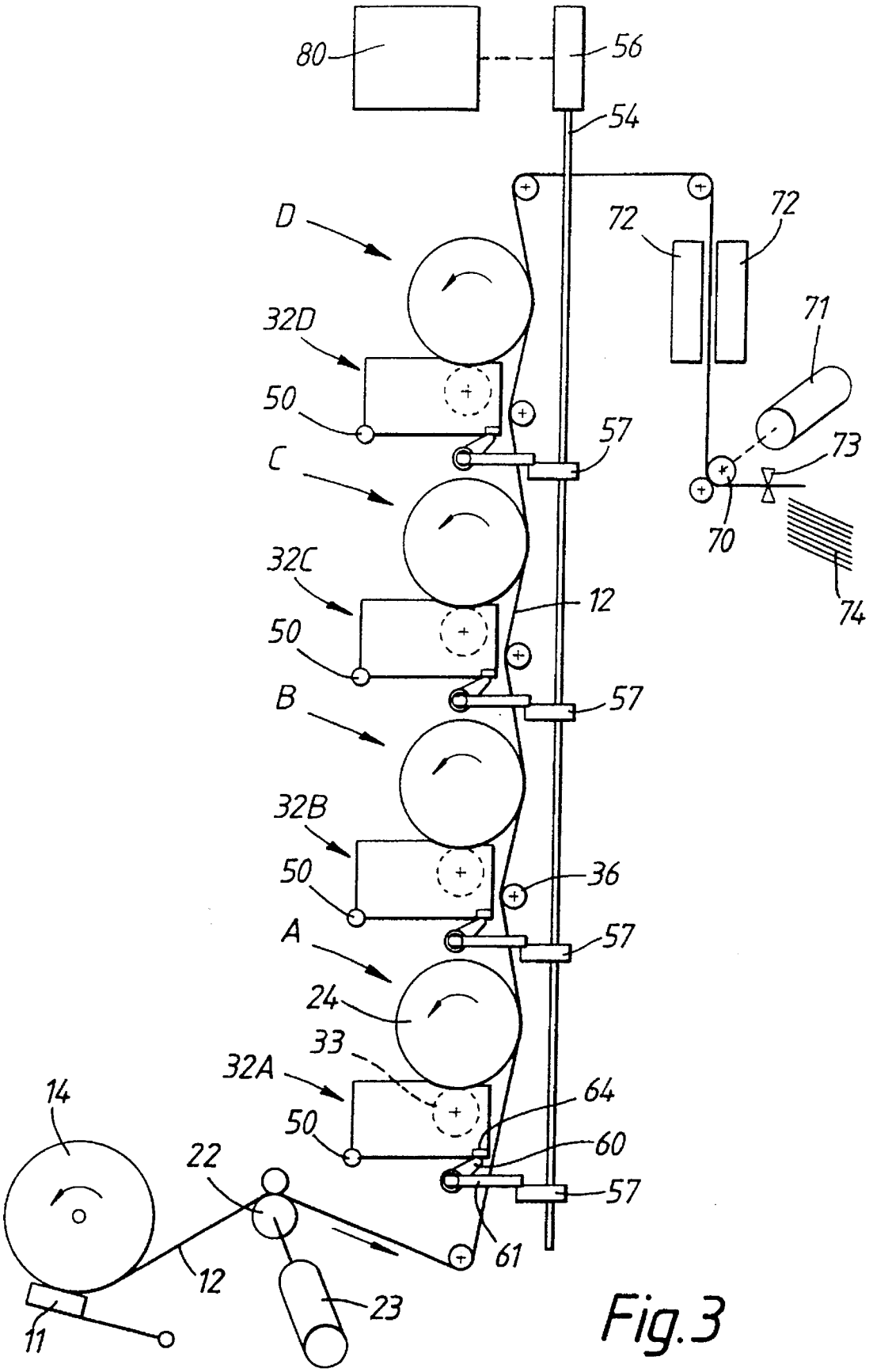

The invention will now be further described, purely by way of example, by reference to the accompanying drawings in which:

FIG. 1 represents a cross-sectional drawing of one of the printing stations of an electrophotographic single-pass multiple station printer according to the invention;

FIG. 2*a* shows the same printing station as in FIG. 1 with the developing unit in a first "non-operative" position;

FIG. 2*b* shows the developing unit in a second "non-operative position"; and FIG. 3 shows schematically an electrostatographic single-pass multiple station printer containing four printing stations.

In FIG. 1 a single printing station of an electrophotographic single-pass multiple station printer is represented by cross-sectional drawing. The printing station comprises a cylindrical drum 24 having a photoconductive outer surface 26. Circumferentially arranged around the drum 24 there is a main corotron or scorotron charging device 28 capable of uniformly charging the drum surface 26, for example to a potential of about −600 volt, an exposure station 30 which may, for example, be in the form of a scanning laser beam or an LED array, which will image-wise and line-wise expose the photoconductive drum surface 26 causing the charge on the latter to be selectively reduced, for example to a potential of about −250 volt, leaving an image-wise distribution of electrostatic charge to remain on the drum surface 26. This so-called "latent image" is rendered visible by means of a developing unit 32 including a driven magnetic brush 33 bringing a two-component developer in the form of a layer containing a mixture of magnetically susceptible carrier particles and toner particles into contact with the drum surface 26. The developing unit 32 is pivotally mounted in that it can pivot around a shaft 50 mounted on a frame member 51 of the printer, enabling the developing unit to be moved towards or away from the drum 24.

In a typical construction of the developing unit 32 operating with the two-component developer, the magnetic brush 33 is formed by means of a driven rotating sleeve 34 having stationary magnets 35 therein, causing the magnetic brush 33 to build up on rotating sleeve 34, the magnetic brush 33 containing magnetically attracted carrier particles loaded with triboelectrically attracted toner particles that transfer to the electrostatic image on the drum surface 26.

The housing 52 also includes, as is known per se, an actuator (not shown) for thoroughly mixing the bulk of the carrier/toner developer.

The position, either operative or non-operative, of the developing unit 32 is obtained through a lever mechanism in which a latch lever 60 fixedly united with a swingable lever 61 retains the right hand frame side of developer unit housing 52 at the centrally located touch point 64. The actuation of the lever mechanism is shown in FIG. 3.

The contact zone of the magnetic brush 33 with the drum surface 26 is adjustable by means of a mechanism containing a lead screw 63 and nut 62, the latter being fixed to the frame of the printer allowing precise positioning of the magnetic brush for obtaining optimal development results.

After development, the toner image adhering to the drum surface 26 is transferred to the moving web 12 by a transfer corona device 38. The moving web 12 is in face-to-face contact with the drum surface 26 over a wrapping angle ω of about 15° determined by the position of the guiding rollers 36. The charge sprayed by the corona device 38, being on the opposite side of the web to the drum, and having a polarity opposite in sign to that of the charge on the toner particles, attracts the toner particles away from the drum surface 26 and onto the surface of the web 12.

The transfer corona 38 also serves to generate a strong adherent force between the web 12 and the drum surface 26, causing the latter to be rotated in synchronism with the movement of the web 12 and urging the toner particles into firm contact with the surface of the web 12. The web, however, should not tend to wrap around the drum beyond the point dictated by the positioning of a guide roller 36 and there is therefore provided circumferentially beyond the transfer corona device 38 a web discharge corona device 59 driven by alternating current and serving to discharge the web 12, thereby allowing the web to become released from the drum surface 26. The web discharge corona device 59 also serves to eliminate sparking as the web leaves the surface 26 of the drum.

Thereafter, the drum surface 26 is pre-charged to a level of, for example −580 volt, by a pre-charging corotron or scorotron device 40. The pre-charging makes the final charging by the corona 28 easier. Thereby any residual toner which might still cling to the drum surface may be more easily removed by a cleaning unit 42 known in the art. The cleaning unit 42 includes an adjustably mounted cleaning brush 43, the position of which can be adjusted towards or away from the drum surface 26 to ensure optimum cleaning. The cleaning brush 43 is earthed or subject to such a potential with respect to the drum 24 as to attract the residual toner particles away from the drum surface 26. After cleaning, the drum surface is ready for another cycle.

FIG. 2*a* illustrates the developing unit 32 in "stand-by" position (first non-operative position), also called "pre-mixing" position before starting printing. The developing unit 32 is pivoted away from the drum 24 such that the magnetic brush 33 is no longer touching the drum surface 26. In the pre-mixing position the carrier-toner bulk inside the housing 52 continues to be mixed by the actuator (not shown).

FIG. 2*b* illustrates a second non-operative position (servicing position) of the developing unit 32 in which after many printing cycles the unit is pivoted further away from the drum 24 into a position where the unit can be removed from the printer for servicing purposes. Outside the printer the developing unit 32 can be cleaned and reloaded with fresh carrier-toner mixture.

FIG. 3 shows schematically an electrostatographic single-pass multiple station printer containing four printing stations A, B, C and D with which pivotable developing units 32A, 32B, 32C and 32D are associated respectively. By means described below these developing units can be brought simultaneously into one of the above defined "working", "pre-mixing" and "servicing" positions.

The printing stations are arranged in a substantially vertical configuration. A web of paper 12 unwound from a supply roller 14 is conveyed in upwards direction past the printing stations in turn. The moving printing web 12 is in face-to-face contact with each drum 24 over a wrapping angle ω as shown in FIG. 1. The web 12 is conveyed through the printer by a drive roller 22 driven by a speed motor 23 and tension in the web is controlled by a drive roller 70 connected to a torque motor 71. The brake 11 acts upon the supply roller 14 as a torque balancing element.

The developing units 32A, 32B, 32C and 32D are each loaded with a two-component developer with different toner, e.g. the units 32A, 32B, 32C and 32D contain yellow, magenta, cyan and black toner particles respectively. The developing units are each pivotally movable around a shaft 50 mounted in a bearing (not shown in the drawing) on a frame member 51 of the printer.

The simultaneous displacement of each of the developing units is controlled by control means 80 for controlling the timed relationship between movement of the developing units and the operation of the printer, in particular to ensure that the drums 24 continue to rotate while the developing units 32A, 32B, 32C, and 32D are moved between their operating and non-operating positions. The control means 80 controls a linear electric motor 56 connected to a common rod 54 with cantilever elements 57 each engaged with a lever mechanism comprising swingable lever 61 and latch lever 60 fixed thereto. The latch lever 60 supports the developing unit at a centrally located touch point 64. By a reciprocating movement of the rod 54 the developing units are brought in either operative position ("working" position of FIG. 1) having a magnetic brush 33 in contact with the drum 24 or in non-operative position including the already mentioned "pre-mixing" position and "servicing" position (see FIG. 2*a* and 2*b*).

As shown in the above explained FIG. 3 the printer is in the form of a multi-station printer comprising a plurality of the image-producing stations, but the invention is not restricted thereto and the means for selectively bringing a developing unit in operative or non-operative position is equally applicable to printers comprising only a single image-producing station.

In the case of a multi-station printer it is not necessary that all the developing units are in the same position during printing since only a limited number of colors, e.g. only black, has to applied and the developing units containing a non-printing color toner have to be in non-operative position. For example, such may be realized by swinging the cantilever elements 57 out of engaging contact with the swingable lever 61.

As shown in FIG. 3 the toner receiving web 12 is unwound from a roll 14 and after transfer of several toner images thereon the toner images are fixed with radiant heat provided by a fixing unit 72. After fixing the toner images the toner receiving web 12 is cut by a cutting means 73 to yield sheets containing the desired image format for receipt in a tray or sheet collector 74.

We claim:

1. An electrostatographic printer for forming an image onto a receptor element, which printer comprises:

(i) at least one toner image-producing electrostatographic station comprising rotatable endless surface means onto which a toner image can be formed, means for forming an electrostatic latent image on said endless surface means and a developing unit for depositing electrostatically charged toner particles onto said electrostatic latent image;

(ii) means for conveying a receptor element in the form of a web past said image-producing station; and (iii) transfer means for transferring said toner image on said rotatable surface means onto said receptor element web, wherein said developing unit is selectively moveable between an operative position and a non-operative position while said endless surface means rotates and said transfer means transfers residual toner image and said endless surface means onto said receptor element web.

2. A printer according to claim 1, wherein said rotatable endless surface means is a drum.

3. A printer according to claim 1, wherein said developing unit comprises a driven rotatable magnetic developing brush in contact with said endless surface means in the operative position of said developing unit.

4. A printer according to claim 1, wherein said developing unit comprises a housing, said housing being pivotally mounted on a frame member of said printer on which said endless surface means is carried.

5. A printer according to claim 1, in the form of a multi-station printer comprising a plurality of said image-producing stations, said printer including means for conveying said receptor element web in succession past each of said image-producing stations.

6. A printer according to claim 5, wherein said developing units at said plurality of image-producing stations are linked together for simultaneous movement between the operative and non-operative positions.

7. A printer according to claim 1, further comprising reciprocating drive means for moving said developing unit between the operating and non-operating positions.

8. A printer according to claim 1, further comprising control means for controlling the timed relationship between movement of said developing unit and operation of said printer.

9. A printer according to claim 8, wherein said control means enable said developing unit to be moved out of the operative position before said rotatable surface means stops rotating.

10. A printer according to claim 8, wherein said control means enable said rotatable surface means to start rotating before said developing unit is moved into the operative position.

11. A printer according to claim 1, wherein said printer is a multi-color printer comprising a plurality of developing units wherein said printer contains means to put at least one of said developing units into an operative position while at least one other developing unit remains in a non-operative position.

12. A printer according to claim 1, wherein said developing unit comprises means for mixing toner particles and carrier particles in said housing of said unit in both the operative and non-operative positions.

13. A printer according to claim 1, comprising means to bring said developing unit into a service position in which said developing unit can be removed from said printer.

14. A method of operating an electrostatographic printer comprising the steps of:

forming an electrostatic latent image on rotatable endless surface means at at least one image-producing electrostatographic station;

depositing electrostatically charged toner particles from a developing unit onto said electrostatic latent image to form a toner image on said rotatable endless surface means;

conveying a receptor element in the form of a web past said image-producing station;

transferring said toner image on said rotatable surface means onto said receptor element web to form an image thereon; and selectively moving said developing unit between an operative position and a non-operative position while said endless surface means rotates and residual toner image on said endless surface means transfers onto said receptor element web.

* * * * *

UNITED STATES PATENT AND TRADEMARK OFFICE

CERTIFICATE OF CORRECTION

PATENT NO. : 5,598,255

DATED : January 28, 1997

INVENTOR(S) : De Cock et al.

It is certified that error appears in the above-indentified patent and that said Letters Patent is hereby corrected as shown below:

Column 8, line 23, "swinging" should read --use of control means 80 to swing--.

Signed and Sealed this

Fourteenth Day of October, 1997

Bruce Lehman

*Attest:*

BRUCE LEHMAN

*Attesting Officer*

*Commissioner of Patents and Trademarks*